US005216212A

United States Patent [19]

Golowash et al.

[11] Patent Number: 5,216,212

[45] Date of Patent: Jun. 1, 1993

[54] DISCONNECT/REVERSING SWITCH

[75] Inventors: Victor Golowash; Wayne S. Rial, both of Bristol, Tenn.

[73] Assignee: Line Power Manufacturing Corporation, Bristol, Va.

[21] Appl. No.: 876,416

[22] Filed: Apr. 30, 1992

[51] Int. Cl.[5] ..... H01H 9/00; H01H 15/02

[52] U.S. Cl. ..... 200/1 V; 200/16 E; 200/18

[58] Field of Search ..... 200/1 V, 16 E, 18, 501, 200/558

[56] References Cited

U.S. PATENT DOCUMENTS 4,563,549 1/1986 Lycan ..... 200/1 V
4,639,558 1/1987 Lycan ..... 200/1 V
4,737,603 4/1988 Lycan ..... 200/18

*Primary Examiner*—J. R. Scott
*Attorney, Agent, or Firm*—Mason Fenwick & Lawrence

[57] ABSTRACT

A combination disconnect/reversing switch for use in explosive environments for isolating an electrical power source from a three-phase motor or for reversing the operation of a motor. The disconnect/reversing switch comprises a handle, mounting plate, front insulator plate, mounting flange, front contact holder, moveable contact holder, rear contact holder, and rear contact retainer. The handle actuates the moveable contact holder between open circuit, or load-grounded, (or reverse in the case of a reversing switch) and closed (or forward) positions. The moveable contact holder contains three electrically conductive pin members which engage corresponding electrical contacts on either the front contact holder, corresponding to the open (or reverse in the case of a reversing switch) position, or rear contact holder, corresponding to the closed (or forward) position. The front and rear contact holders are maintained at a fixed distance from each other by three electrically conductive connector rods upon which is slideably mounted the moveable contact holder. Electrical connections are established between the pin members and the conductive connector rods by electrically conductive bus bars also located on the moveable contact holder.

11 Claims, 9 Drawing Sheets

DISCONNECT/REVERSING SWITCH

BACKGROUND OF THE INVENTION

1. Field of the Invention.

The invention relates generally to electrical switches and more particularly to disconnect switches for use in isolating an electrical source from a three phase motor and reversing switches for reversing operation of a three phase motor.

Disconnect switches of the type contemplated by the patent are used to electrically isolate equipment such as generators, circuit breakers and step up transformers from their power source and reversing switches are used to operate a motor in either forward or reverse direction. When operating equipment in explosive environments, such as a coal mine, there is a need to ensure that the disconnect/reversing switch is explosion-proof to prevent electrical sparks from igniting methane gasses in the mine shaft. Therefore, any disconnect/reversing switch to be used in conjunction with coal mining equipment must meet explosion-proof enclosure requirements established by the Mine Safety and Health Administration (MSHA). Further, a disconnect/reversing switch attached to electrical equipment is required by national standards to provide means for connecting the load-side conductors of the motor to a ground source when the motor is disconnected from the electrical power source.

Explosion-proof operation is achieved by journaling the operating shaft of the disconnect/reversing switch in such a way as to provide sufficient axial length and minimum clearance between the shaft and operating bore such that any explosion within the switch resulting from sparks and a mixture of explosive gas, such as methane gas will be quenched by the time it exits the switch through the clearance between the shaft and bore.

2. Related Art.

A typical disconnect switch is described in U.S. Pat. No. 4,737,603 issued Apr. 12, 1988 to Jennings Lycan. The Lycan disconnect switch comprises a cam-operated handle assembly that moves the switch from open, load-grounded, to closed position. The disconnect switch contains two fixed members and a moveable member, wherein the moveable member has six contacts to engage sockets on either fixed member according to the position of the switch. Further, the motor is grounded by means of wire jumpers which connect the two fixed members. While this switch functions to disconnect a motor from its source of power, the cam-driven handle assembly is difficult to operate and the wire jumpers used to ground the motor are not an integral part of the unit. Further, an aperture insulator drum is required to secure the two fixed contact members an equal distance from each other, adding to the assembly costs.

A typical reversing switch is described in U.S. Pat. No. 4,563,549 issued Jan. 7, 1986 to Jennings Lycan. The Lycan reversing Switch comprises a cam-operated handle assembly that permits axial and rotational movement. The reversing switch comprises a fixed member containing four sockets and a moveable member having four contacts to engage the sockets on the fixed member. In operation, the moveable member must be rotated 90 degrees to reverse the operation of the motor. While the switch functions to reverse the operation of a motor, the cam-driver handle assembly is difficult to operate and requires a two-step operation to reverse the direction of the motor.

There is no disclosure of a combination disconnect-/reversing switch in the prior art. This type of switch would be beneficial in situations where the moto is located a distance from the power source and where space is limited such that both switches may not be physically located at the same place at the same time. Further, the use of two switches is inefficient and costly when a single switch can accomplish both functions.

SUMMARY OF THE INVENTION

Therefore, it is a primary object of the present invention to provide a combination disconnect/reversing switch which may be used in explosive environments.

Another object is to provide a combination disconnect/reversing switch wherein the handle assembly operates in vertical plane with a minimum resistance between open, load-grounded and closed positions when functioning as a disconnect switch, and between forward and reverse operation when functioning as a reversing switch.

Another object is to provide a combination disconnect/reversing switch wherein the switch is manufactured from a minimal number of parts to ensure reliability and operating effectiveness.

Another object is to provide a combination disconnect/reversing switch wherein the operating shaft journal meets requirements for explosion proof journaling as established by the Mine Safety and Health Adminstration.

Another object is to provide a combination disconnect/reversing switch that operates in a minimal amount of space.

A further object is to provide a combination disconnect/reversing switch wherein the handle is connected to a moveable contact holder that operates between two fixed contact holders.

Another object is to provide a disconnect switch wherein the means for interconnecting the motor and ground in the open position is an integral part of the disconnect switch.

These objects and more are satisfied by the present invention which comprises a combination disconnect-/reversing switch for use in isolating a three phase electrical power source from a motor and for use in reversing a three phase motor. The disconnect/reversing switch of the present invention comprises a handle assembly, mounting plate, front insulator plate, mounting flange, front contact holder, moveable contact holder, rear contact holder, and rear contact retainer. The handle assembly comprises a spring loaded handle which rotates 180 degrees through a central axis between open and load-grounded positions for disconnect switch function and between forward direction operation for reversing switch function. Operation of the switch is accomplished through the use of a centrally located shaft wherein on end of the shaft is connected to the moveable contact holder and the other end of the shaft is connected to the handle assembly by a pair of linkages. When functioning as a disconnect switch, the handle is in the open position (or when functioning as a reversing switch, the handle is in the reversing position), and the moveable contact holder engages the front contact holder, thereby grounding the motor from its power source (or causing the motor to operate in the reverse direction). When the handle is in the closed position (or forward position), the moveable contact holder engages the rear contact holder, thereby connecting the three phase electrical power source to the motor (or causing the motor to operate in the forward direction).

DETAILED DESCRIPTION OF THE PREFERRED EMBODIMENTS

Figure 1:
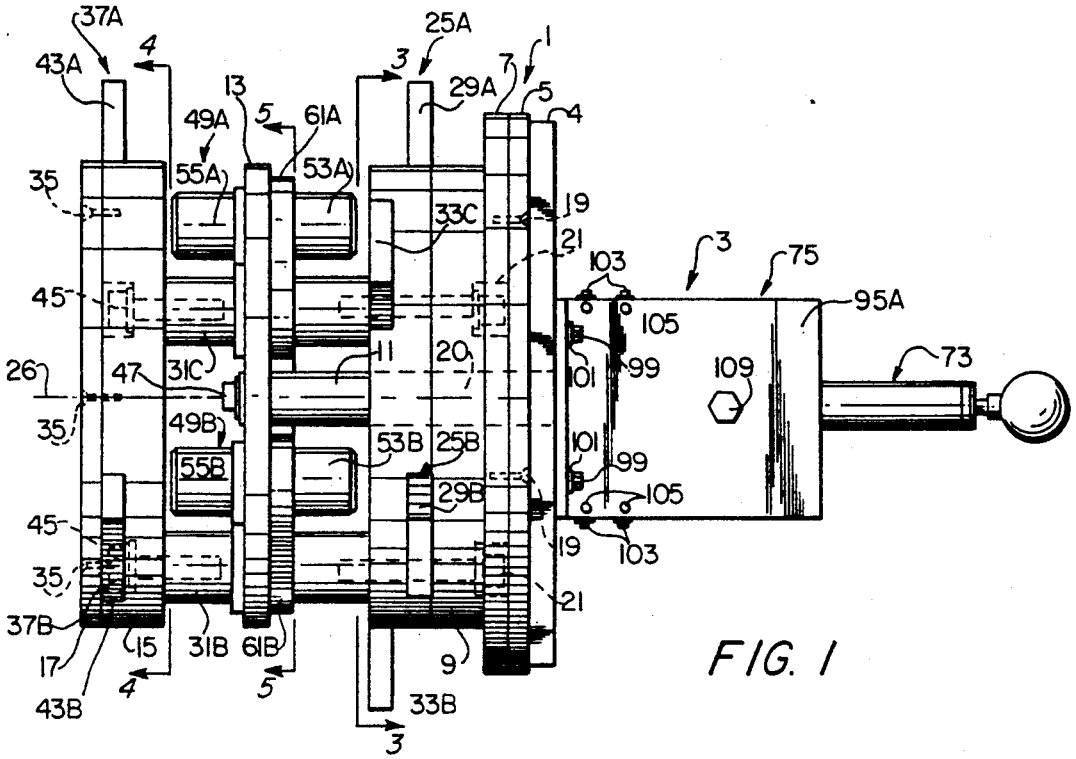
FIG. 1 is a side view of the combination disconnect-/reversing switch in intermediate position between closed (or forward) and open positions (or reverse).

Referring first to FIG. 1, the combination disconnect-/reversing switch 1 of the present invention is shown in intermediate position between open, load-grounded, (or reverse) and closed (or forward) position. The major components of the disconnect/reversing switch 1 include handle assembly 3, mounting plate 4, front insulator plate 5, mounting flange 7, front contact holder 9, shaft 11, moveable contact holder 13, rear contact holder 15, and rear contact retainer 17. Front insulator plate 5 is secured to mounting flange 7 by a series of bolts 19 and the front insulator plate 5, mounting flange 7, and front contact holder 9 contain a bore 20 in which the shaft 11 is located. The bore 20 is sized in such a way as to permit movement of shaft 11 with relatively little resistance.

Figure 2:
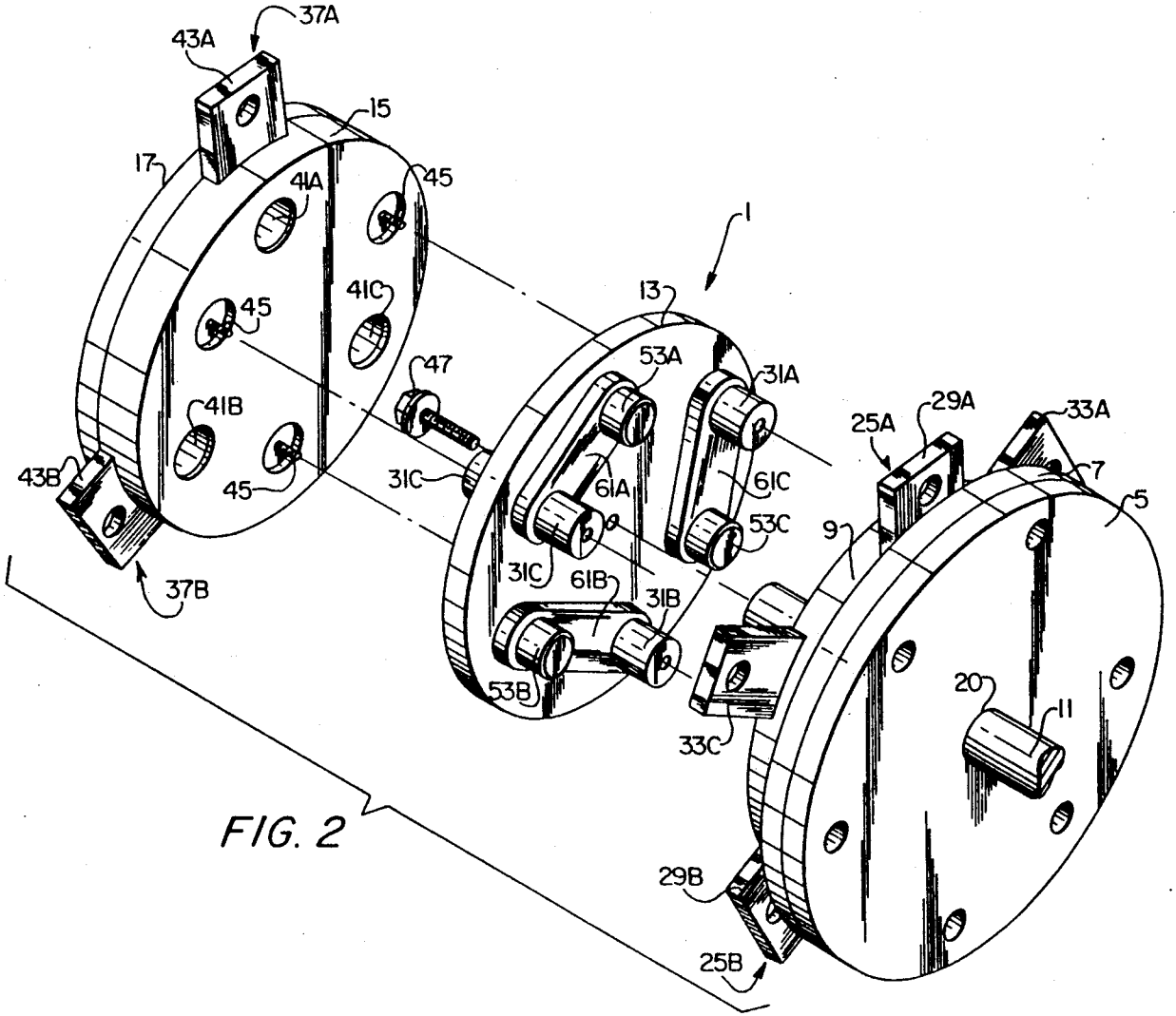
FIG. 2 is a perspective view of the combination disconnect/reversing switch.

In FIG. 2 there is shown a perspective view of the disconnect/reversing switch 1 of the present invention. This view shows the front insulator plate 5, mounting flange 7, moveable contact holder 13, rear contact holder 15 and rear contact retainer 17, in relationship to each other as assembled.

Figure 3:
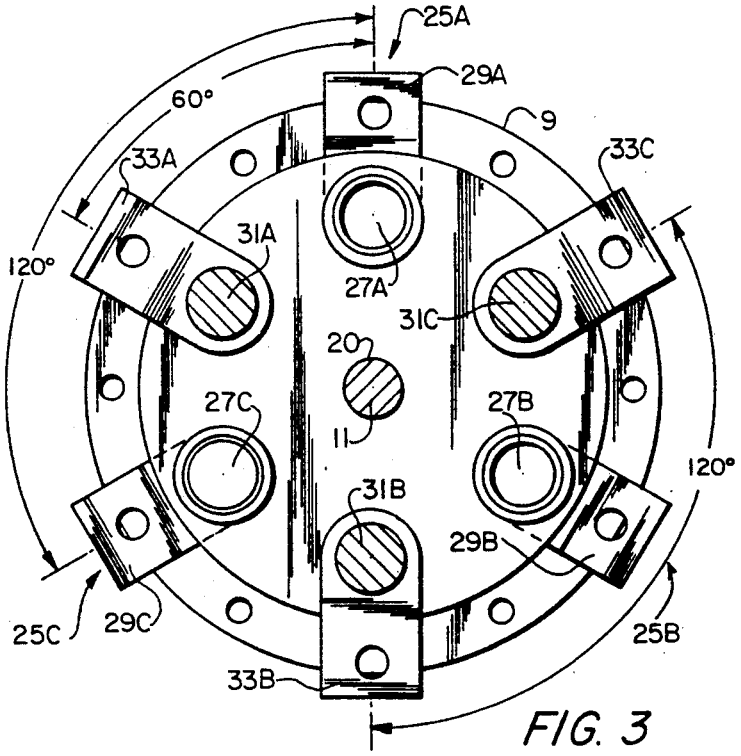
FIG. 3 is a oross-sectional view of the combination disconnect/reversing switch shown in FIG. 1 taken along section line 3—3 showing the front contact holder.

Referring next to FIG. 3, in conjunction with FIGS. 1 and 2, there is shown a cross-sectional view of the front contact holder 9 of the disconnect/reversing switch 1 shown in FIG. 1 taken along section line 3—3. The front contact holder 9 is disc shaped and manufactured from an electrically insulative material. The front contact holder 9 is attached to the mounting flange 7 by a series of bolts 21. The front contact holder 9 functions as the grounding connection for the three phase motor connected to the disconnect/reversing switch 1 when used as a disconnect switch. When used as a reversing switch, the front contact holder 9 functions as the connection for the three-phase motor and electrical source connected to disconnect switch 1.

Referring to FIGS. 1 and 2, the front contact holder 9 contains a centrally disposed bore 20 in which the shaft 11 is located. The bore 20 is sized in such a way as to permit movement of shaft 11 with relatively little resistance.

Referring to FIGS. 1, 2, and 3, the front contact holder 9 contains three electrically conductive grounding (or input in the case of a reversing switch) power contacts 25A, 25B, and 25C. In the preferred embodiment, the three electrically conductive grounding (or input) power contacts 25A, 25B, 25C are arranged concentric about the longitudinal axis 26 containing the centrally disposed bore 20 such that the angle between any two of the three contacts 25A, 25B, 25C is 120 degrees (as shown in FIG. 3). Each power contact 25A, 25B, 25C comprises a female socket contact 27A, 27B, 27C and an electrically conductive terminal contact 29A, 29B, 29C. During operation of the combination switch 1 as a grounding switch, the three electrically conductive terminal contacts 29A, 29B, 29C are connected to the ground (G) (FIGS. 6 and 7). When operating as a reversing switch, the three electrically conductive terminal contacts 29A, 29B, 29C are connected to the three leads (L1, L3, L2, respectively) of the three-phase power source used to power the motor (FIGS. 8 and 9).

Referring to FIGS. 1 and 3, attached to the front contact holder 9 by bolts 21 ar three electrically conductive connector rods 31A, 31B, 31C. In the preferred embodiment, the three electrically conductive connector rods 31 ar arranged concentric about the longitudinal axis 2 containing the centrally disposed bore 20 at the same radius as the three power contacts 25A, 25B, 25C such that the angle between any two of the three rods 31 is 120 degrees (as shown in FIG. 3). Further, the connector rods 31 are equally spaced between the power contacts 25A, 25B, 25C such that the angle between any connector rod 31A, 31B, 31C and adjacent power contact 25A, 25B, 25C is 60 degrees (as shown in FIG. 3). Each connector rod 31A, 31B, 31C attached to front contact holder 9 is attached to an electrically conductive terminal contact 33A, 33B, 33C. During operation of the combination switch 1 as a grounding switch or reversing switch, the three electrically conductive terminal contacts 33A, 33B, 33C are connected to the three leads (LD3, LD2, LD1, respectively) of the threephase machinery (FIGS. 6, 7, 8 and 9).

Figure 4:
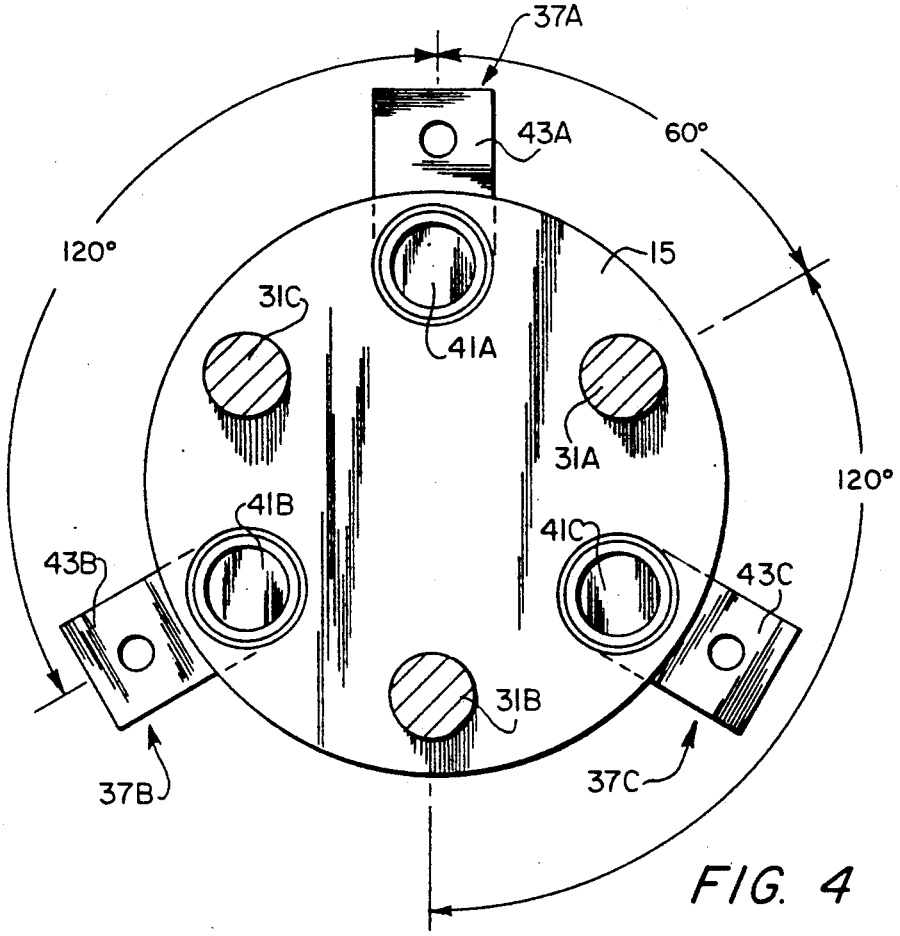
FIG. 4 is a cross-sectional view of the combination disconnect/reversing switch shown in FIG. 1 taken along section line 4—4 showing the rear contact holder.

Referring next to FIG. 4, in conjunction with FIGS. 1 and 2, there is shown a cross-sectional view of the rear contact holder 15 of the disconnect/reversing switch 1 shown in FIG. 1 taken along section line 4—4. The rear contact holder 15 is disc shaped and manufactured from an electrically insulative material. The rear contact holder 15 is attached to the rear contact retainer 17 by a series of bolts 35. The rear contact holder 15 functions as the input location for the three-phase power source connected to the disconnect/reversing switch 1.

Referring to FIGS. 1 and 4, the rear contact holder 15 contains three electrically conductive input power contacts 37A, 37B, 37C. In the preferred embodiment, the three electrically conductive input power contacts 37A, 37B, 37C are arranged concentric about the longitudinal axis 26 containing the centrally disposed bore 20 at the same radius as the power contacts 25A, 25B, 25C on the front contact holder 9 such that the angle between any two of the three contacts 37A, 37B, 37C is 120 degrees (as shown in FIG. 4). Further, these contacts 37A, 37B, 37C are arranged such that three radials extending from the longitudinal axis 26. Each radial is spaced 120 degrees apart, and contains a power contact 25A, 25B, 25C and input power contact 37A, 37B, 37C, respectively. Each input power contacts 37A, 37B, 37C comprises a female socket contact 41A, 41B, 41C and an electrically conductive terminal contact 43A, 43B, 43C. During operation of the switch 1, the three electrically conductive terminal contacts 43A, 43B, 43C are connected to the three leads (L1, L2, L3, respectively) of the power source (FIGS. 6, 7, 8 and 9).

Referring again to FIGS. 1 and 4, attached to the rear contact holder 15 by bolts 45 are three electrically conductive connector rods 31A, 31B, 31C. In the preferred embodiment, the three electrically conductive connector rods 31A, 31B, 31C are arranged concentric about the longitudinal axis 26 containing the bore 20 at the same radius as the three electrically conductive input power contacts 37A, 37B, 37C such that the angle between any two of the three rods 31A, 31B, 31C is 120 degrees (as shown in FIG. 4). Further, the contact/connector rods 31A, 31B, 31C are equally spaced between the input power contacts 37A, 37B, 37C such that the angle between any contact/connector rod 31A, 31B, 31C and adjacent power contact 37A, 37B, 37C is 60 degrees (as shown in FIG. 4). In this arrangement, the contact/connector rods 31A, 31B, 31C secure the front contact holder 9 and rear contact holder 15 an equal distance apart from each other.

Figure 5:
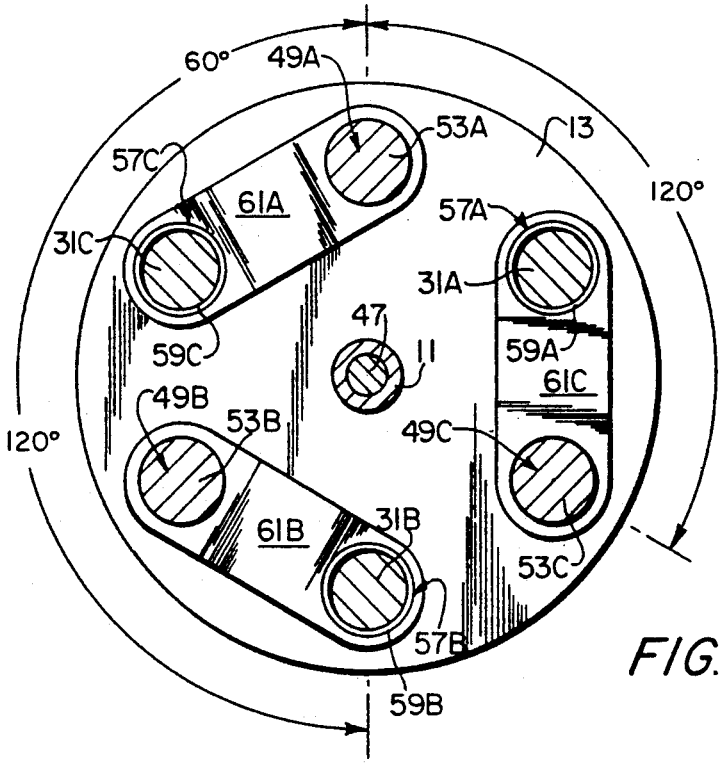
FIG. 5 is a cross-sectional view of the combination disconnect/reversing switch show in FIG. 1 taken along section line 5—5 showing the moveable contact holder.

Referring next to FIG. 5, in conjunction with FIGS. 1 and 2, there is shown a view of the moveable contact holder 13 of the disconnect switch 1 shown in FIG. 1 taken along section line 5—5. The moveable contact holder 13 is disc shaped and manufactured from an electrically insulative material. The contact holder 13 is attached to one end of shaft 11 by a scre 47 and located between the front contact holder 9 and rear contact holder 15.

Referring again to FIGS. 1, 2, and 5, the moveable contact holder 13 contains three electrically conductive contact pin members 49A, 49B, 49C. Each of the contact pin members 49A, 49B, 49C contains two, electrically conductive pins arranged opposite one another such that the three front facing electrically conductive pins 53A, 53B, 53C face the front contact holder 9 and the three rear facing electrically conductive pins 55A, 55B, 55C face the rear contact holder 15. In the preferred embodiment, the three moveable contact pin members 49A, 49B, 49C are arranged concentric about the longitudinal axis 26 containing the centrally disposed bore 20 at the same radius as the power contacts 25A, 25B, 25C on the front contact holder 9 such that the angle between any two of the three pin members 49A, 49B, 49C are 120 degrees (as shown in FIG. 5). Further, these pin members 49A, 49B, 49C are arranged such that three planes coexisting with the longitudinal axis 26 and each spaced 120 degrees apart each contain a power contact 25A, 25B, 25C, input power contact 37A, 37B, 37C, and moveable contact pin members 49A, 49B, 49C, respectively.

As shown in FIG. 5, the moveable contact holder 13 also contains three holes 57A, 57B, 57C arranged concentric about the longitudinal axis 26 containing the bore 20 at the same radius as the three moveable contact pin members 49A, 49B, 49C such that the angle between any two of the three holes 57A, 57B, 57C is 120 degrees. Further, the holes 57A, 57B, 57C are equally spaced between the moveable contact pin members 49A, 49B, 49C such that the angle between any holes 57A, 57B, 57C and adjacent moveable pin members 49A, 49B, 49C is 60 degrees. Each hole 57A, 57B, 57C is fitted with an electrically conductive ring 59A, 59B, 59C sized slightly larger in diameter than connector rod 31A, 31B, 31C to permit conductive connector rod 31A, 31B, 31C to pass therethrough with minimal resistance yet maintain electrical conductivity between the ring 59A, 59B, 59C and corresponding conductive connector rod 31A, 31B, 31C.

Referring to FIG. 5, the moveable contact holder 13 further contains three electrically conductive bus bar plates 61A, 61B, 61C. One end of each bus bar plate 61A, 61B, 61C is in electrical contact with a contact pin member 49A, 49B, 49C and the other end is in electrical contact with an adjacent electrically conductive ring 59C, 59B, 59A, respectively.

Figure 6A:
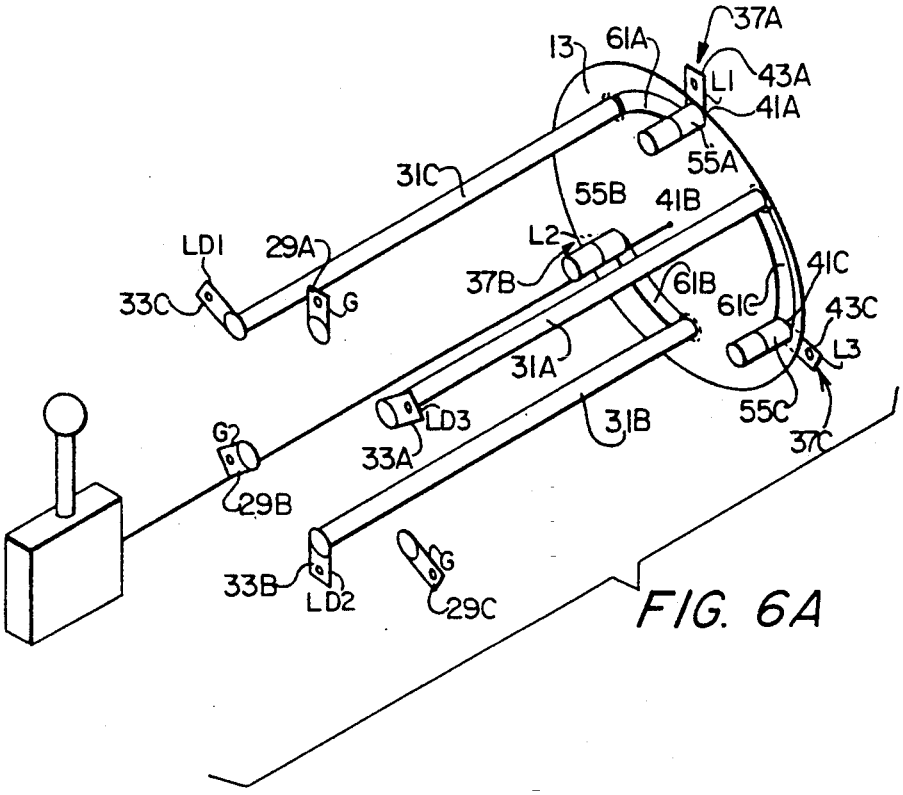
FIG. 6A is a schematic view of the combination disconnect/reversing switch's electrical circuit in the closed, or load-energized position.
Figure 7A:
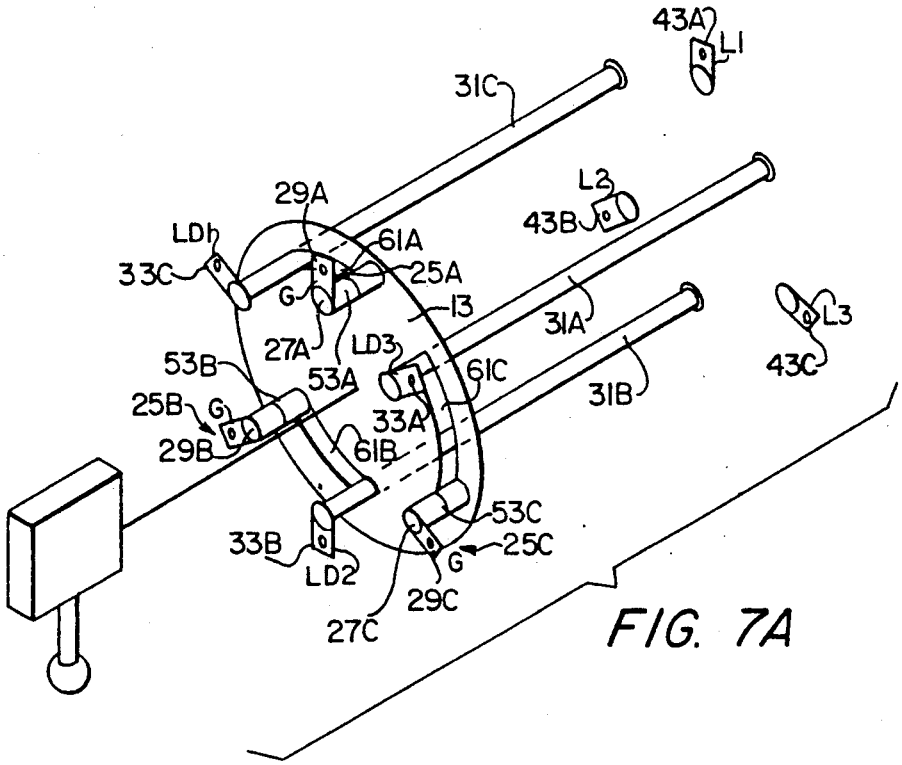
FIG. 7A is a schematic view of the combination disconnect/reversing switch's electrical circuit in the open, load-grounded position.

With reference to FIGS. 6A and 7A, a schematic is shown of the combination disconnect/reversing switch's electrical circuit functioning as a disconnect switch in closed position and open, load-grounded, position, respectively. In both arrangements, the three electrically conductive terminal contacts 29A, 29B, 29C of power contacts 25A, 25B, 25C contained on the front contact holder 9 are each connected to a separate grounding source represented in the figures as G. Further, the three electrically conductive terminal contacts 33A, 33B, 33C of the connector rods 31A, 31B, 31C are each connected to a single phase of the three-phase motor represented in FIGS. 6A and 7A as LD3, LD2, and LD1, respectively. On the rear contact assembly 15 (not shown), the three electrically conductive terminal contacts 43A, 43B, 43C are each connected to a single phase of the three-phase power source represented in the figure as L1, L2 and L3, respectively.

Referring now to FIGS. 1, 4, 6A and 6B, in the closed position, moving contact holder 13 electrically engages rear contact holder 15 such that the three rear facing electrically conductive pins 55A, 55B, 55C (FIG. 1) each engage a female socket contact 41A, 41B, 41C (FIG. 4) on input power contacts 37A, 37B, 37C. In this arrangement, the motor connected to LD1, LD2, and LD3 (FIGS. 6A and 6B) is in electrical contact with the power source connected to leads L1, L2, and L3. This electrical contact is accomplished by the three phases of th motor (LD1, LD2, LD3) being in electrical contact with each of the three electrically conductive terminal contacts 33C, 33B, 33A, (FIG. 3) respectively, in electrical contact with the conductive connector rods 31C, 31B, 31A which in turn are in electrical contact with a bus bar plate 61A, 61B, 61C and electrically connect to a corresponding rear facing electrical contact pin 55A, 55B, 55C which in turn is in contact with a female socket contact 41A, 41B, 41C (FIG. 4) connected to a terminal 43A, 43B, 43C.

Figure 6B:
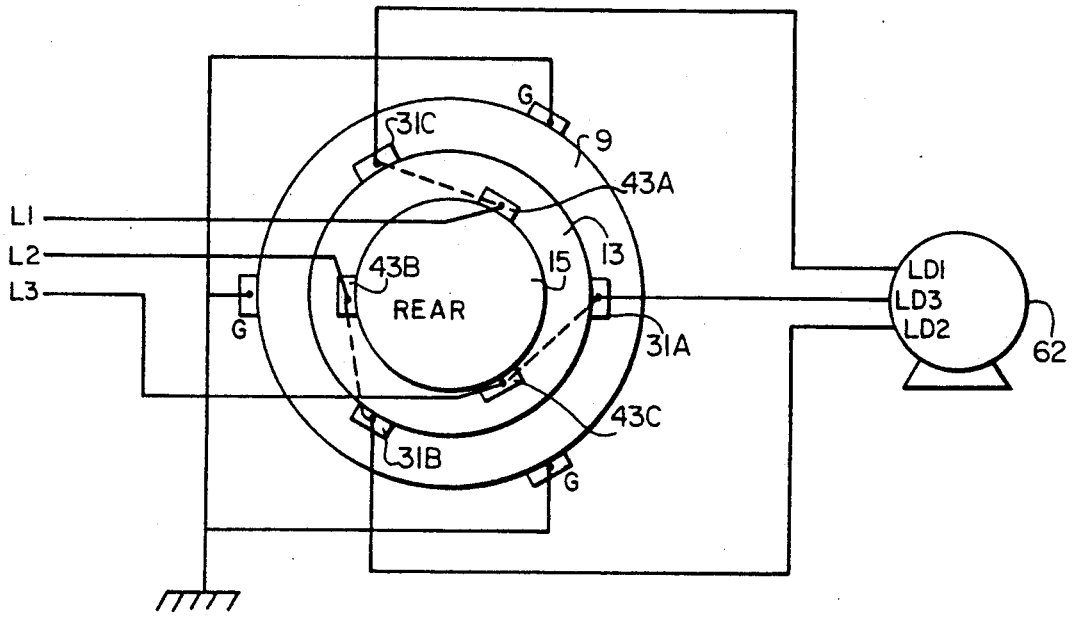
FIG. 6B is an electrical schematic of the combination disconnect/reversing switch's electrical circuit connecting a power source to a motor.

FIG. 6B is a schematic of the circuit when the switch is in the forward position to operate a motor. The numbering of components in the schematic corresponds to the physical components shown in FIG. 6A.

Figure 7B:
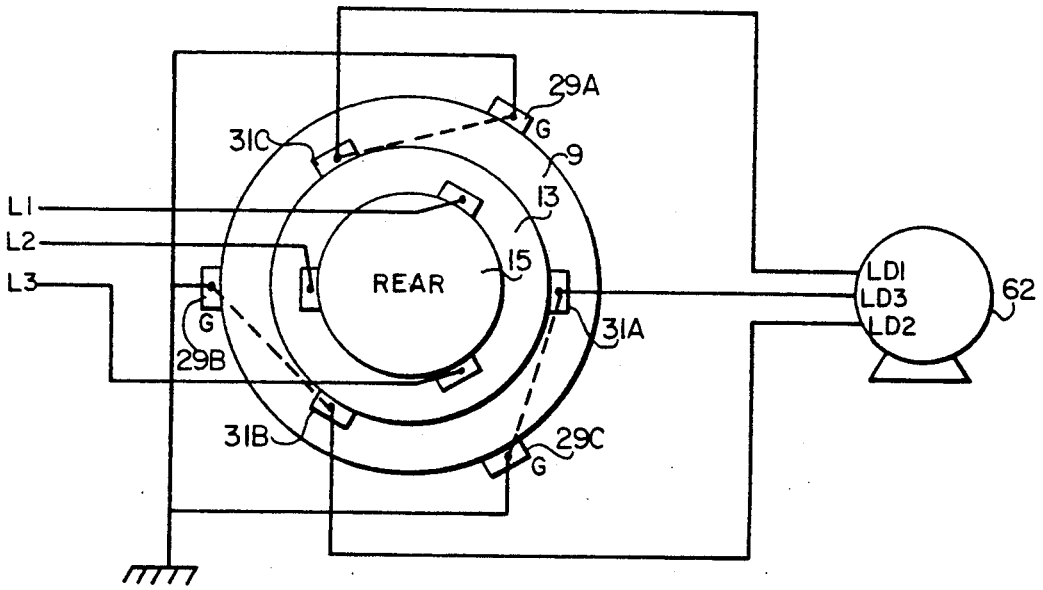
FIG. 7B is an electrical schematic of the combination disconnect/reversing switch's electrical circuit to isolate a power source from a motor, and to ground the motor.

Referring now to FIGS. 7A and 7B, in the open, load-grounded, position, moving contact member 13 electrically engages front contact holder 9 such that the three front facing electrically conductive pins 53A, 53B, 53C (FIG. 5) of contact pin members 49A, 49B, 49C each engage a female socket contact 27A, 27B, 27C (FIG. 5) on power contacts 25A, 25B, 25C. In this arrangement, the motor connected to LD1, LD2, and LD3 is grounded from the power source connected to leads L1, L2, and L3. This grounding is accomplished by the three phases of the motor (LD1, LD2, LD3) being in electrical contact with each of the three electrically conductive terminal contacts 33C, 33B, 33A (FIG. 3), respectively, of the conductive connector rods 31C, 31B, 31A which in turn are in electrical contact with a bus bar plate 61A, 61B, 61C in electrical contact with a corresponding front facing electrical contact pin 53A, 53B, 53C which in turn is in electrical contact with a female socket contact 27A, 27B, 27C (FIG. 3) connected to a terminal 29A, 29B, 29C.

FIG. 7B is a schematic of the circuit when the switch is open, or in a load-grounding position, to isolate the motor 62 from the electrical current and to ground the motor. The numbering in the schematic corresponds to the physical components shown in FIG. 7A.

Figure 8A:
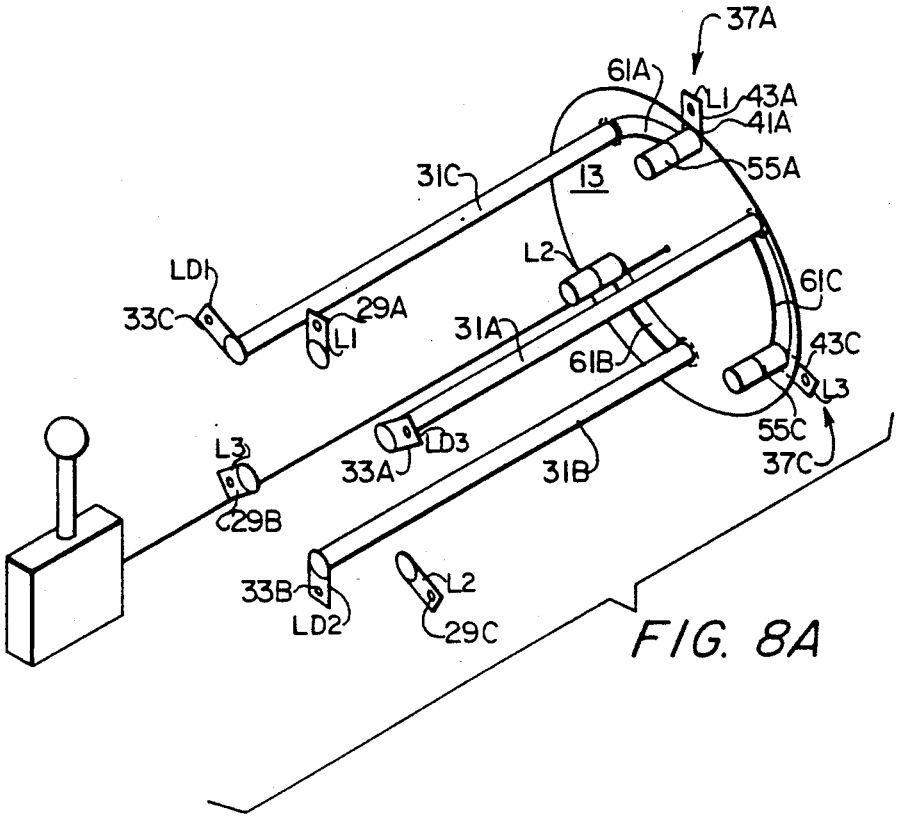
FIG. 8A is a schematic view of the combination disconnect/reversing switch's electrical circuit in the forward position.
Figure 9A:
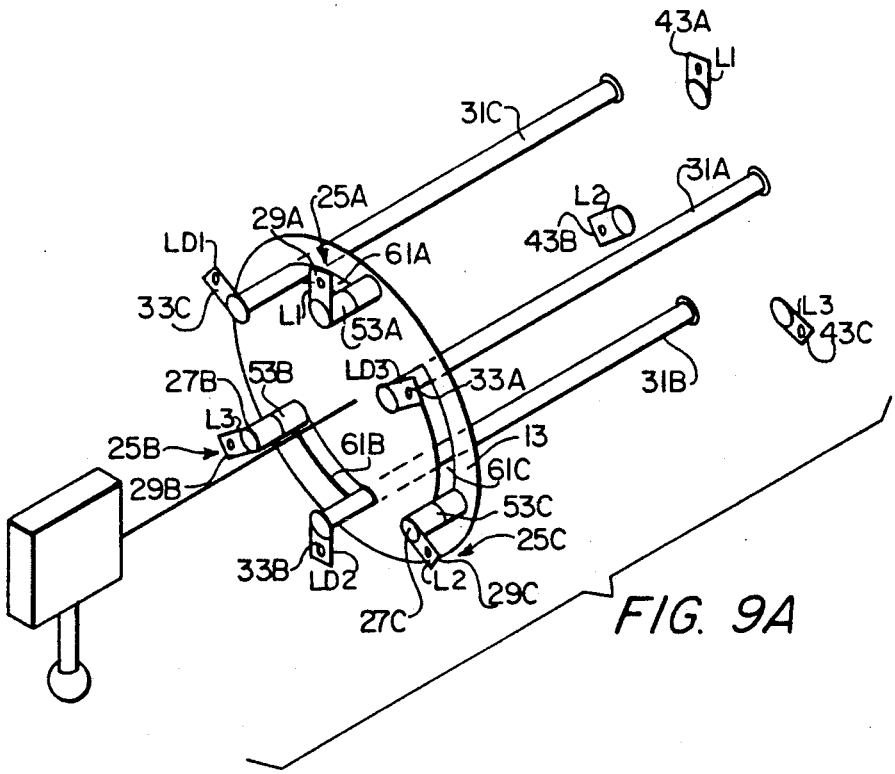
FIG. 9A is a schematic view of the combination disconnect/reversing switch's electrical circuit in the FIG. 9B is an electrical schematic of the combination disconnect/reversing switch's electrical circuit connecting a power source to a motor to run it in the reverse direction.

With reference to FIGS. 8A and 9A, a schematic view is shown of the combination disconnect/reversing switch's electrical circuit functioning as a reversing switch in forward position and reverse position, respectively. In both arrangements, the three electrically conductive terminal contacts 29A, 29B, 29C (FIG. 3) of power contacts 25A, 25B, 25C mounted on the front contact holder 9 are each connected to a single phase of the three-phase power source represented in the figures as L1, L3, and L2, respectively. Further, the three electrically conductive terminal contacts 33A, 33B, 33C of the conductive connector rods 31A, 31B, 31C are each electrically connected to a single phase of the three-phase motor represented in the figures as LD3, LD2 and LD1, respeotively. On the rear contact assembly 15 (FIGS. 2 and 4) the three electrically conductive terminal contacts 43A, 43B, 43C are each electrically connected to a single phase of the three-phase power source represented in the figures as L1, L2, and L3.

Referring now to FIG. 8A, in the forward position, moving contact holder 13 is in contact with rear contact holder 15 (FIGS. 2 and 4) such that the three rear facing electrically conductive pins 55A, 55B, 55C (FIG. 1) each engage a female socket contact 41A, 41B, 41C (FIG. 2) on input power contacts 37A, 37B, 37C. In this arrangement, the motor connected to LD1, LD2, and LD3 is in electrical contact with the power source connected to leads L1, L2 and L3 such that L1 is connected to LD1, L2 is connected to LD2, and L3 is connected to LD3. This electrical contact is accomplished by the three phases of the motor (LD1, LD2, LD3) being in electrical contact with each of the three electrically conductive terminal contacts 33C, 33B, 33A, respectively, of the conductive connector rods 31C, 31B, 31A which in turn are in electrical contact with a bus bar plate 61A, 61B, 61C in electrical contact with a corresponding rear facing electrical contact pins 55A, 55B, 55C which in turn are in contact with a female socket contact 41A, 41B, 41C connected to a terminal 43A, 43B, 43C.

Figure 8B:
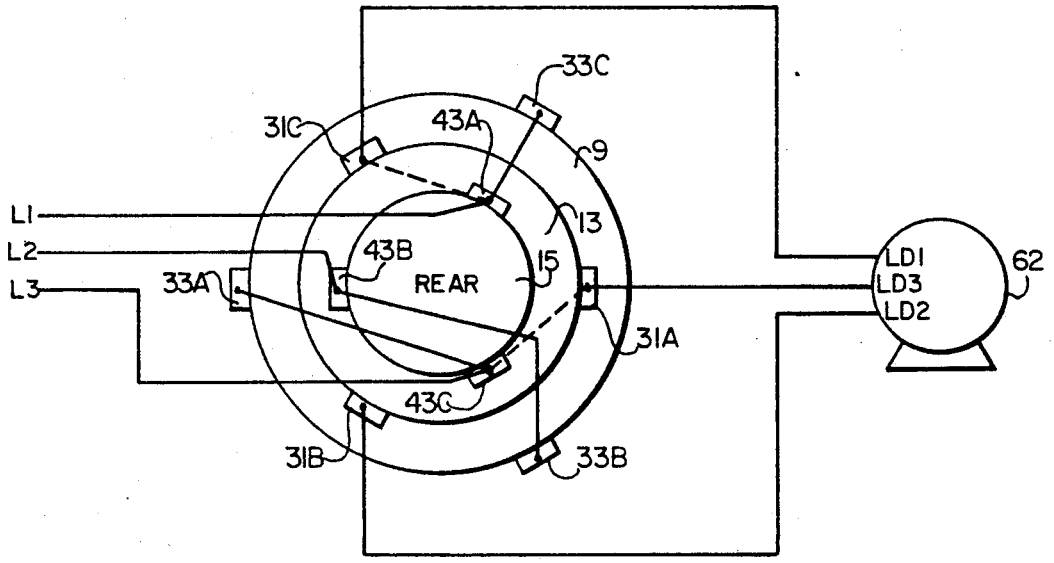
FIG. 8B is an electrical schematic of the combination disconnect/reversing switch's electrical circuit connecting a power source to a motor to run it in the forward direction.

FIG. 8B is a schematic of the circuit when the switch is in the forward position to operate a motor. The numbering of components in the schematic corresponds to the physical components shown in FIG. 8A.

Referring now to FIG. 9A, in the reverse position, moving contact 13 is in contact with front contact holder 9 such that the three front facing electrically conductive pins 53A, 53B, 53C each engage a female socket contact 27A, 27B, 27C (FIG. 3) on power contacts 25A, 25B, 25C. In this arrangement, the motor connected to LD1, LD2 and LD3 is in electrical contact with the power source connected to leads L1, L2, and L3 such that L1 is connected to LD1, L2 is connected to LD3, and L3 is connected to LD2. This electrical contact is accomplished by the three phases of the motor (LD1, LD2, LD3) being in electrical contact with each of the three electrically conductive terminal contacts 33C, 33B, 33A, respectively, of the conductive connector rods 31C, 31B, 31A which in turn are in electrical contact with a bus bar plate 61A, 61B, 61C each of which is in electrical contact with a corresponding front facing electrical contact pin 53A, 53B, 53C which in turn is in contact with a female socket contact 27A, 27B, 27C connected to a terminal 29A, 29B, 29C.

Figure 9B:
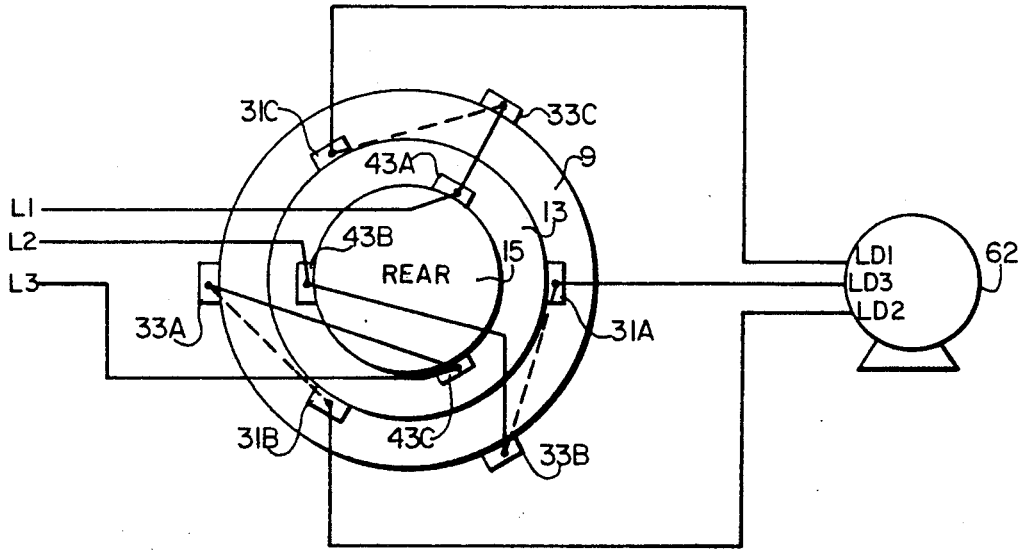

FIG. 9B is a schematic of the circuit when the switch is in the position to run a motor in reverse. The numbering of components in the schematic corresponds to the physical components shown in FIG. 9A.

Figure 10:
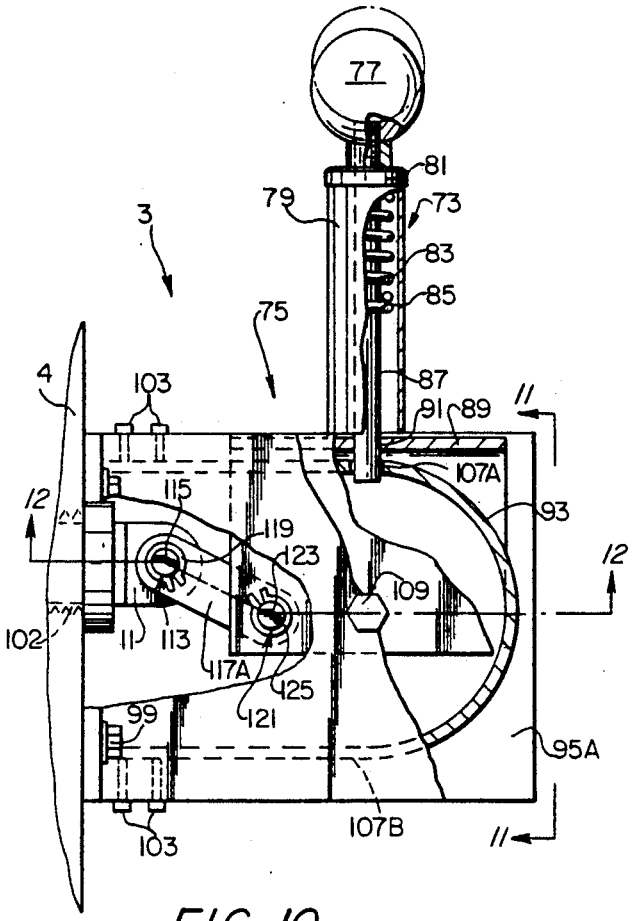
FIG. 10 is a cut-away side view of the handle assembly in the closed (or forward) position.
Figure 11:
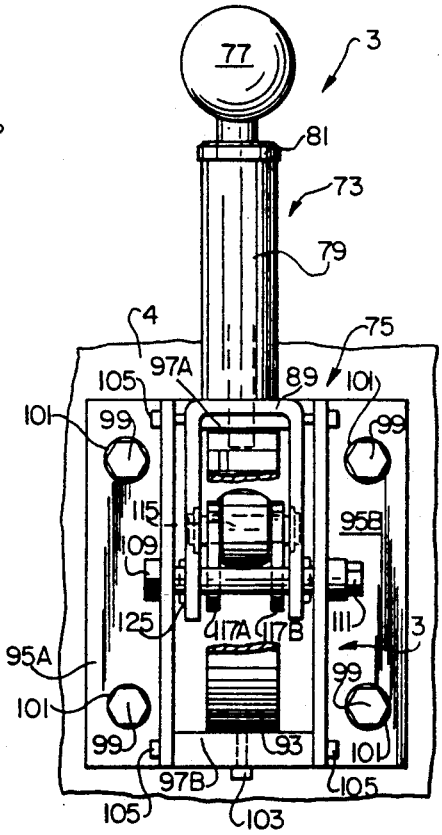
FIG. 11 is a cross-sectional view of the handle assembly shown in FIG. 10 taken along section line 11—11.
Figure 12:
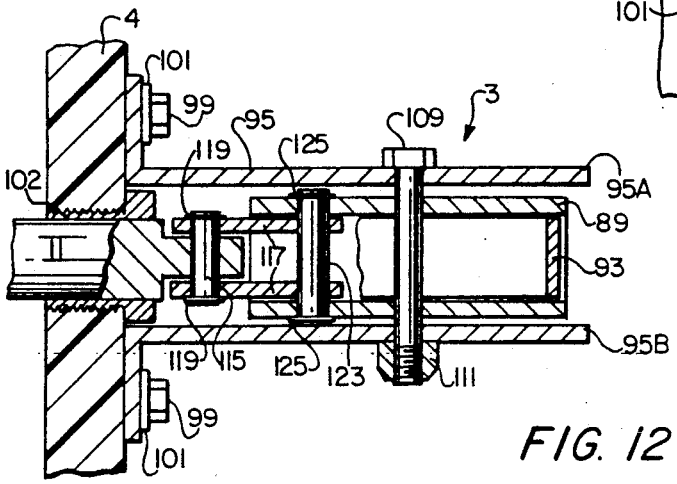
FIG. 12 is a cross-sectional view of the handle assembly shown in FIG. 10 taken along section line 12—12.
Figure 13:
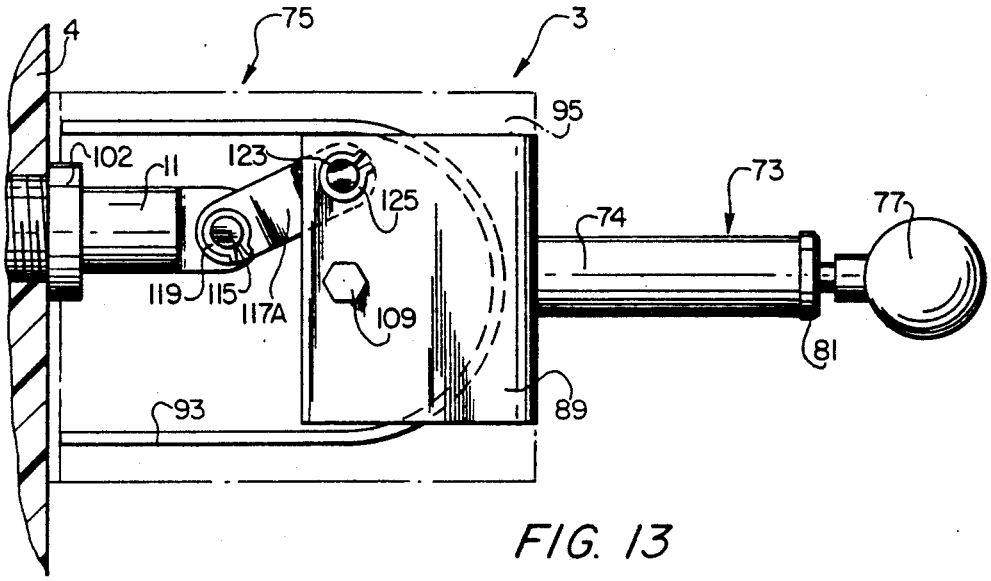
FIG. 13 is a out-away view of the handle assembly in the intermediate position between open, load-grounded, (or reverse) and closed (or forward) position.

Referring to FIGS. 10, 11, 12, 13 and 14, there is shown the handle assembly 3 of the disconnect/reversing switch 1 of the present invention. In FIG. 10, a cut-away view of the handle assembly 3 is shown in the closed position (or forward position in the case of a reversing switch). Referring to FIG. 11, in conjunction with FIG. 10, there is shown a cross-sectional view of the handle assembly 3 taken along section line 11—11 in closed position (or forward position in the case of a reversing switch). In FIG. 12 there is shown a sectional view of the handle assembly 3 in FIG. 10 taken along section line 12—12. In FIG. 13 there is shown the handle assembly 3 of the present invention in intermediate position between open (or reverse) and closed (or forward) position. Finally, in FIG. 14 there is shown the handle assembly 3 of the present invention in open, load-grounded, position (or reverse position in the case of a reversing switch).

Referring to FIGS. 10, 11 and 12, the handle assembly 3 has a handle 73 and housing 75. The handle 73 is comprised of a knob 77, handle casing 79, outer shell bushing 81, spring 83, roll pin 85, shaft 87 and operating bar 89. The shaft 87 is located within handle casing 79 wherein one end of the shaft 87 extends beyond the casing 79 into the housing 75 and the other end of the shaft 87 extends beyond the handle casing 79 to come in contact with, and attach to, the knob 77. The top of the handle casing 79 is covered by an outer handle bushing 81 which is securely fastened to the hand casing 79 using any suitable method.

Referring again to FIGS. 10, 11 and 12, located within the handle casing 79 surrounding the shaft 87 is a spring 83. Securely fastened to the interior of the handle casing 79 is a circular roll pin 85 of a slightly less diameter as the inner diameter of the handle casing 79. The spring 83 is located between the outer handle casing 81 and roll pin 85. The roll pin 85 is located in casing 79 such that one end of the spring 83 in resting position, non-compressed, comes in contact with the outer handle bushing 81 and the other end of the spring 83 comes in contact with the roll pin 85. The handle casing 79 is securely fastened to the operating bar 89 by any suitable method such as welding. Further, operating bar 89 is fitted with a hole 91 such that the shaft 87 will protrude through the hole 91 in the operating bar 89 into the housing 75.

Again, with reference to FIGS. 10, 11 and 12, housing 75 comprises a detent plate 93, two operator bearing plates 95A, 95B, and two detent plate holders 97A, 97B. Operating bar 89 is located between the two operating bearing plates 95A, 95B and surrounds the detent plate 93. Each operator bearing plate 95A, 95B is secured to the mounting plate 4 by two bolts 99 wherein each bolt has on washer 101 associated with it (as shown in FIGS. 1 and 11). Located within mounting plate 4 is a bushing 102 through which shaft 11 is inserted. Detent plate 93 is secured to each detent plate holder 97A, 97B by two bolts 103 and each detent plate holder 97A, 97B is secured to the operator bearing plates 95A, 95B by four bolts 105. Detent plate 93 contains two detents 107A, 107B each located 180 degrees from the other.

With reference to FIGS. 10 and 11, handle 73 is secured between the operator bearing plates 95 by means of a bolt 109 which passes through one operator bearing plate 95A, the operating bar 89 and extends beyond the other operator bearing plate 95B. The assembly is secured together by means of a flex-lock nut 111 fitted on the end of the bolt 109.

Again, with reference to FIGS. 10 and 11, located within shaft 11 is a hole 113 through which a grooved pin 115 is inserted. In communication with shaft 11 and located on grooved pin 115 are a pair of linkages 117A, 117B. Each linkage 117A, 117B is held in place on the grooved pin 115 by means of an external retaining ring 119. The other end of each linkage 117A, 117B is located on the underside of the operating bar 89 such that the hole in each linkage 117A, 117B is aligned with the holes 121 in the operating bar 89. A grooved pin 123 is inserted through one end of the operating bar 89, passes through the two linkages 117A, 117B and exits the other side of operating bar 89. Each linkage is held in place on the grooved pin 123 by means of an external retaining ring 125.

As shown in FIGS. 10 and 11, the handle 73 is in the upright position which corresponds to the disconnect-/reversing switch 1 being in the closed (or forward) position. In this arrangement, shaft 87 engages the upper detent 107A.

To move the disconnect/reversing switch 1 from the closed (or forward) position shown in FIGS. 10 and 11 to the intermediate position shown in FIG. 13, the knob 77 is pulled upward so that shaft 87 is disengaged from detent 107. The handle 73 is then swung downward with the shaft 87 coming in contact with the detent plate 93. The detent plate 93 functions to guide the handle 73 through its movement. The handle 73 pivots about an axis centered on bolt 109. As the handle 73 moves from closed (or forward) open to intermediate position, the grooved pin 123 attached to the operating bar 89 of the handle 73 is also displaced in a clockwise direction. As the grooved pin 123 is being displaced, there is a corresponding movement of shaft 11 from the closed (or forward) to the intermediate position. This movement of shaft 11 is due to linkages 117A, 117B being connected to shaft 11 by grooved pin 115, and being connected to grooved pin 123 located on operating bar 89. As shown in FIG. 13, when the handle 73 is in the intermediate position, grooved pin 123 and bolt 109 coexist in the same vertical plane.

Figure 14:
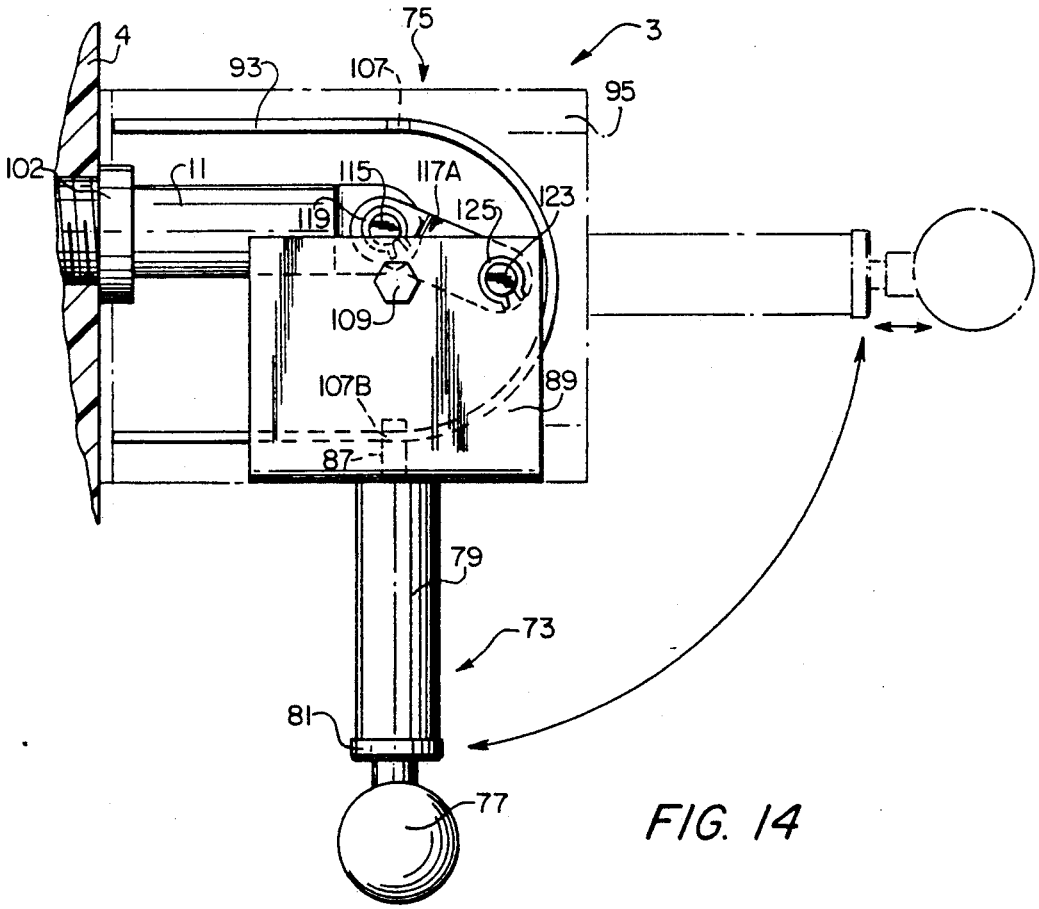
FIG. 14 is a cut-away view of the handle assembly in open, load-grounded, (or reverse) position.

When the disconnect/reversing switch 1 is moved from grounded, (or reverse) position as shown in FIG. 14, handle 73 is shifted 90 degrees in the clockwise direction. This movement of handle 73 is guided by detent plate 93 through its contact with shaft 87. As before, handle 73 rotates about an axis centered on bolt 109. As the handle 73 moves from intermediate to open (or reverse) position, the grooved pin 123 attached to the operating bar 89 of the handle 93 is also displaced in a clockwise direction. As the grooved pin 123 is being displaced, there is a corresponding movement of shaft 11 from the intermediate to open position (or reverse). This movement of shaft 11 is due to linkages 117A, 117B being connected to shaft 11 by grooved pin 115, and being connected to grooved pin 123 located on operating bar 89. When the handle 73 is located in the open (or reverse) position, shaft 87 engages detent 107B as shown in FIG. 14. Thus, the handle 73 has moved 180 degrees from the closed (or forward) position as shown in FIG. 10 to the open, load-grounded, (or reverse) position as shown in FIG. 14.

The disconnect/reversing switch 1 may be moved from the open (or reverse) position, as shown in FIG. 14, to the intermediate position, as shown in FIG. 13, by first pulling on knob 77 located on handle 73 in the vertical direction. This movement of knob 77 in the vertical direction disengages shaft 87 from detent 107B. The handle 73 is then moved counterclockwise through an angle of 90 degrees pivoting about an axis containing bolt 109. The detent plate 93 provides a means of guiding the handle 73 through its movement since shaft 87 is in contact with the detent plate 93. As the handle 73 is being moved counterclockwise, groove pin 123 is also displaced counterclockwise since it is attached to operating bar 89. As grooved pin 123 is being displaced, the shaft 11 slides the moveable contact holder from being in electrical contact with front holder 9 toward the rear contact holder 15 since linkages 117A, 117B are attached to shaft 11 by grooved pin 115 and attached to operating bar 89 by grooved pin 123. As shown in FIG. 13, the handle 73 is located in the intermediate position. In this position, grooved pin 123 and bolt 109 are in the same vertical plane.

To move the handle 73 from the intermediate position, as shown in FIG. 13, to the closed (or forward) position as shown in FIGS. 10 and 11, the handle 73 is moved counterclockwise through a range of 90 degrees until shaft 87 engages detent 107A. As this movement occurs, grooved pin 123 also moves in a counterclockwise direction about an axis containing bolt 109 since grooved pin 123 is attached to the operating bar 89. As this occurs, the shaft 11 attached to moveable contact member 13 is moved toward rear contact holder 15 since linkages 117A, 117B are attached to operating bar 89 by grooved pin 123 and attached to the shaft 11 by grooved pin 115. When the handle 73 is located in the closed (or forward) position, as shown in FIG. 10, the shaft 87 enqaqes detent 107 and the qrooved pin 123 and bolt 109 coexist in the same horizontal plane.

The foregoing description of the preferred embodiment is exemplary of the invention, and does not limit its scope.

I claim:

1. A combination disconnect/reversing switch for use in isolating an electric motor from its source of electric power or reversing the operation of a motor comprising:

a mounting plate having a central bore;

a front insulator plate having a central bore adhered to said mounting plate;

a mounting flange having a central bore adhered to said mounting plate;

a plurality of electrically conductive connector rods;

a front contact holder mounted on said mounting flange and a rear contact holder, each secured an equal distance apart by said electrically conductive connector rods, said front contact holder having three electrically conductive power contacts and a centrally disposed bore in axial alignment with said bores of said mounting flange, front insulator and mounting plate, and said rear contact holder having three electrically conductive input power contacts;

a shaft slideably disposed within the bores of said mounting plate, front insulator plate, mounting flange and said front contact holder;

a moveable dielectric contact holder, having opposed surfaces, secured to said shaft, said moveable contact holder having three electrically conductive contact pin members disposed on each surface in axial alignment with said power contacts on said front and rear contact holders alternatively, conductive openings for slideably mounting said moveable contact holder on said electrically conductive connector rods, and three electrically conductive bus bar plates providing an electrical connection between each of said moveable contact pin members and said conductive openings; and a handle assembly connected to said shaft for moving said moveable contact holder to engage said pins thereon into alternate contact with said front and rear power contacts.

2. The disconnect/reversing switch of claim 1 wherein said shaft is jounraled for axial movement in said bore to maintain an explosion-proof fit.

3. The disconnect/reversing switch of claim 1 wherein said front insulator plate, mounting flange, front contact holder, rear contact holder and moveable contact holder are manufactured from electrically insulative material.

4. The disconnect/reversing switch of claim 1, wherein:

said power contacts on said front contact holder and said input power contacts on said rear contact holder are radially disposed around said bore such that the angle of arc between any two of said three contacts is about 120 degrees.

5. The disconnect/reversing switch claimed in claim 1, wherein the handle assembly comprises a housing, pivotal and linkage means within said housing for connecting said shaft with a handle extending from said housing.

6. The disconnect/reversing switch of claim 1, further comprising a spring biased detent for holding said handle in a fixed position.

7. The disconnect/reversing switch for use in isolating an electrical circuit or reversing the operation of a motor comprising:

a mounting plate having a bore;

a front insulator plate having a bore adhered to said mounting plate with is bore in axial alignment with the bore of said mounting plate;

a mounting flange having a bore, said bore adhered to said front insulator plate with its bore in axial alignment with the bores of said mounting plate and front insulator;

a front contact holder haivng a centrally disposed bore for receiving a shaft, said shaft being slideably disposed within said bores of said mounting plate, front insulator and front contact holder, and journaled for axial movement in the bore of said front contact holder to maintain an explosion-proof fit, said front contact holder further comprising three electrically conductive power contacts equally spaced concentric about said shaft;

a rear contact holder having three electrically conductive input power contacts equally spaced concentric about the longitudinal axis coexisting with said shaft;

three electrically conductive connector rods wherein one end of each said rod is fastened to the front contact holder and the other end is fastened to the rear contact holder, said fastened ends are arranged concentric about the longitudinal axis containing said shaft, said conductive connector rods maintaining the front contact holder and rear contact holder at an equal distance form each other;

a moveable contact holder having opposign surfaces secured to said shaft, said moveable contact holder having on its opposed surfaces, electrically conductive moveable contact pin members equally spaced concentric about said shaft, said contact holder slideably mounted by conductive holes therein on said conductive connector rods;

three electrically conductive bus bar plates located on said moveable contact holder each providing an electrical connection between one of said moveable contact pin members and one of said conductive connector rods; and handle means for actuating said shaft to move said moveable contact holder to engage its contact pins with said power contacts on said front and rear contact holders alternatively.

8. The disconnect/reversing switch claimed in claim 7, wherein:

each moveable contact pin member comprises two pins arranged on said moveable contact holder on opposing surfaces thereof, such that alternatively, said front contact holder conductively engages its power contacts with said moveable contact pins and said moveable contact pins facing the rear contact holder power contacts conductively engage the input power contacts on said rear contact holder in response to actuation by said handle assembly.

9. The disconnect/reversing switch claimed in claim 7, wherein the handle means comprises a pivoted handle traveling in a vertical plane 180 degrees between closed and opened positions, said handle is attached to an operating bar pivoting in the same horizontal plane as said handle, and said operating bar is flexibly connected to said shaft, to slideably activate said shaft.

10. The disconnect/reverse switching claimed in claim 7, further comprises a detent means for securing said handle means in fixed positions.

11. The disconnect/reversing switch claimed in claim 7, wherein:

each power contact comprises a female socket to receive a pin on said moveable contact pin member when the switch is in the open/reverse position, said female socket contacts each being electrically connected to an electrically conductive terminal;

each input power contact comprises a female socket contact to engage a pin on said moveable contact pin member when the switch is in the closed/forward position, said female socket contacts each being electrically connected to an electrically conductive terminal; and each conductive connector rod end attached to said front contact holder is in electrical contact with an electrically conductive terminal.

* * * * *